United States Patent [19]

Iaslovits

[11] Patent Number: 4,860,895

[45] Date of Patent: Aug. 29, 1989

[54] STEMWARE HOLDER

[75] Inventor: Michael Iaslovits, North Miami Beach, Fla.

[73] Assignee: Safetray, Inc., Miami, Fla.

[21] Appl. No.: 65,090

[22] Filed: Jun. 22, 1987

Related U.S. Application Data

[63] Continuation-in-part of Ser. No. 49,655, May 4, 1987.

[51] Int. Cl.[4] ..... A65D 85/44

[52] U.S. Cl. ..... 206/426; 206/560; 206/565; 206/480

[58] Field of Search ..... 206/565, 426, 560, 480, 206/478, 483

[56] References Cited

U.S. PATENT DOCUMENTS

| | | | |
|---|---|---|---|
| 774,479 | 11/1904 | Lange | 206/565 |
| 817,148 | 4/1906 | Allen | 206/565 |
| 2,602,310 | 7/1952 | Hansen | 206/565 |
| 3,881,674 | 5/1975 | Greene, III | 206/426 |
| 4,204,598 | 5/1980 | Adams | 206/426 |

*Primary Examiner*—Joseph Man-Fu Moy
*Attorney, Agent, or Firm*—Robert C. Kain, Jr.

[57] ABSTRACT

In one embodiment, the stemware holder includes two, thin, elongated, semi-concave fingers, integral at their aft regions, that define a dome rising from a tray surface. The top of the dome is truncated and is open. The inboard edges of the fingers define a fore entry slot, a converging throat, a circular, central section at the truncated top of the dome, and a stress relief slot section extending aft from the circular section. The stemware holder is attached to the tray surface at the aft region. In one embodiment, this attachment is a tab protruding upward from the plane of said tray surface wherein a base portion of the tab extends through a through passage in the tray between the tray surface and the side wall of the tray. Ribs are disposed at an intermediate location on the top surface of the fingers and run longitudinal between the stress relief slot section and the outboard edge of each finger.

38 Claims, 2 Drawing Sheets

STEMWARE HOLDER

This application is a continuation-in-part, of application Ser. No. 049,655, filed may 4, 1987.

BACKGROUND OF THE INVENTION

The present invention relates to a holder for stemware to restrain individual pieces of stemware from movement with respect to a tray surface.

Principally in the restaurant and catering business, it is necessary to serve a number of people with drinks and beverages in stemware or glasses. This stemware has a generally circular base, a narrow, high stem rising from the base and a cup or liquid retaining portion atop the stem. These glasses or stemware are placed on a tray surface and hence the stemware is subject to move across the tray surface due to movement of the entire tray by the waiter or waitress. The poor stability of the stemware on the tray causes spillage from the cup portion as well as breakage of the stemware when the glasses fall from the tray or collide with each other.

U.S. Pat. No. 2,602,310 to Hansen discloses a clip-on stemware holder having two fingers attached at an aft region with a V-shaped slot opened at the fore end of the holder and defined by the inboard edges of the fingers. Various lateral cross-sections of the holder are planar and the aft regions of the holder are raised above the tray surface higher than the other regions of the holder, the fore regions of the holder are tapered toward the tray surface thereby engaging the base of the stemware along the fore underside surfaces of the holder. U.S. Pat. No. 774,479 to Lange discloses a tray for glasses wherein a rack extends above the tray surface and has a plurality of slots therein into which the stem of the stemware fits. Springs are disposed beneath the rack on either side of the slots to retain side sections of the base of the stemware. U.S. Pat. No. 817,148 to Allen discloses a tray for lasses utilizing spring type holders. Generally, the spring type holders restrain the base of the stemware along a line parallel to the longitudinal center line of the tray. The outboard edge of the base of the stemware is restrained by a side wall of the tray.

OBJECTS OF THE INVENTION

It is an object of the present invention to provide a stemware holder that restrains the base of stemware against a tray surface.

It is another object of the present invention to provide a stemware holder which is a shallow dome structure rising from the tray surface.

It is a further object of the present invention to provide a stemware holder that is flexible and resilient and which grips the base of the stemware along facing arcuate contact regions.

It is a further object of the present invention to utilize a stress relief shaped slot to minimize fatigue and failure of the stemware holder due to the flexing of the holder when inserting and withdrawing the stemware.

It is an additional object of the present invention to utilize a pair of ribs that force the stemware holder downward when stemware is inserted into the holder; the ribs extend longitudinally with respect to a pair of fingers that define the dome and the ribs intermediate the stress relief slot section and the outboard edges of the fingers and are disposed in the aft region of the fingers.

It is a further object of the present invention to provide a tray with multiple stemware holders and a central region having a high coefficient of friction surface that enables the server to place plates of food or other items on the central region as well as restrain a plurality of stemware in the holders outside of said central region.

SUMMARY OF THE INVENTION

In one embodiment, the stemware holder includes two, thin, elongated, semi-concave fingers, integral at their aft regions, that define a dome rising from a tray surface. The top of the dome is truncated and is open. The inboard edges of the fingers define a fore entry slot, a converging throat, a circular, central region at the truncated top of the dome, and a stress relief slot region extending aft from the circular region aft. The stemware holder is attached to the tray surface at the aft region. In one embodiment, this attachment is a tab protruding upward from the plane of said tray surface wherein a base portion of the tab extends through a through passage in the tray between the tray surface and the side wall of the tray. Ribs are disposed at an intermediate location on the top surface of the fingers and run longitudinal between the stress relief slot section and the outboard edge of each finger. In another embodiment, depending clips extend through through-passages neat the side wall of the tray. The tab's outboard surface rests against the side wall and the ribs extend to the inboard surface of the tab.

BRIEF DESCRIPTION OF THE DRAWINGS

Further objects and advantages of the present invention can be found in the detailed description of the preferred embodiments when taken in conjunction with the accompanying drawings in which:

FIG. 5 illustrates a broken away, cross-sectional view of the aft portion of the stemware holder without a piece of stemware being restrained;

DETAILED DESCRIPTION OF THE PREFERRED EMBODIMENTS

The present invention relates to a stemware holder for restraining or retaining a piece of stemware, and particularly the base of the stemware, against a tray surface, as well as a tray having a plurality of these stemware holders.

Figure 3:
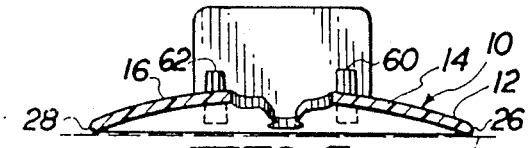
FIG. 3 illustrates a lateral, cross-sectional view of the stemware holder from the perspective of section line 3'–3'' in FIG. 1.
Figure 2:
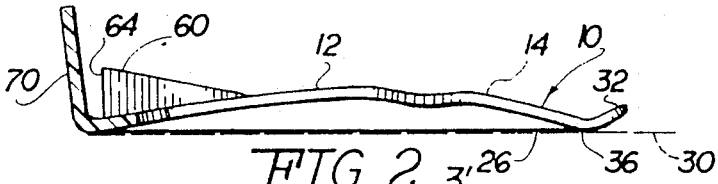
FIG. 2 illustrates a longitudinal, cross-sectional view of the stemware holder from the perspective of section line 2'–2'' in FIG. 1.
Figure 1:
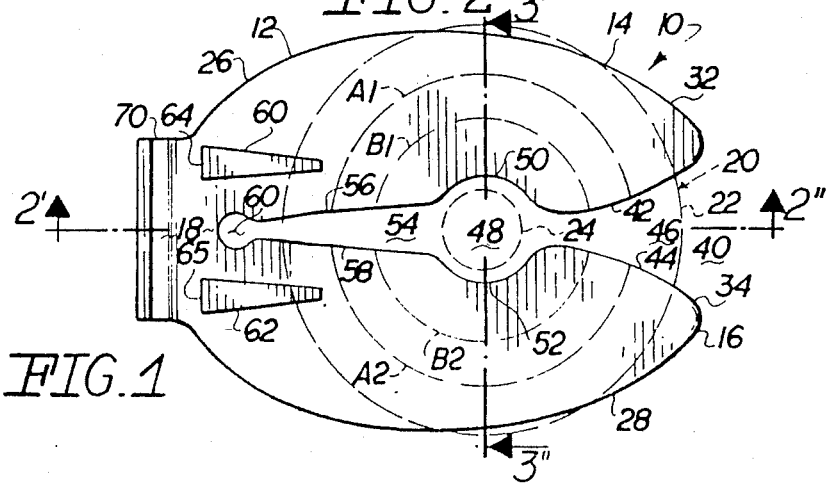
FIG. 1 illustrates a top view of the stemware holder with the base and the stem of the stemware shown in dashed outline.

FIGS. 1, 2 and 3 will be discussed concurrently since FIG. 1 illustrates a top view, FIG. 2 illustrates a longitudinal, cross-sectional view, and FIG. 3 illustrates a lateral, cross-sectional view of the stemware holder. Similar numerals designate similar items throughout all the figures. FIGS. 1, 2 and 3 show stemware holder 10 as a dome structure 12 that is defined by two longitudinally extending, semi-concave, fingers 14 and 16 integrally attached at their aft region 18. An important feature of the present invention is dome 12 because the dome structure can accommodate various types of stemware, one of which is stemware 20 shown in dashed outline in FIG. 1. More importantly, the dome, comprised of flexible, resilient fingers 14 and 16, enables base 22 to be held at arcuate contact regions beneath each finger 14 and 16. For example, stemware 20 may be held at arcuate contact regions $A_1$and $A_2$respectively designating a band of contact surface sections respectively beneath fingers 14 and 16. Alternately, if base 22 of stemware 20 were higher than in the previous example, the base maybe held along arcuate contact regions $B_1$and $B_2$respectively designating bands of contact surface sections beneath fingers 14 and 16. It is important to note that these arcuate contact regions face each other and provide for a maximum amount of contact between the fingers and the base notwithstanding the size of the base. Therefore, stem 24 interacts with the inboard edges of fingers 14 and 16 a minimal amount since the principal restraining action occurs at the underside surface of fingers 14 and 16 along the arcuate contact surface sections f those fingers.

Dome 12 is a shallow dome having a truncated top. Dome 12 is defined by fingers 14 and 16 because outboard edges 26 and 28, respectively of fingers 14 and 16, are substantially in contact with the tray surface 30 as shown in FIGS. 2 and 3. Alternatively, edge 26 and 28 can be in close proximity to (for example 1/32 inches away from) tray surface 30. As used herein, the term "outboard" refers to items on the outer periphery or away from stem 24 of stemware 20 (i.e., away from the truncated top of dome 12). Conversely, the term "inboard" refers to items that are closer to stem 24 or the top of the dome. The term "fore" refers to items on the right-hand side of holder 10 as shown in top view of FIG. 1; the term "aft" refers to items on the left-hand side of the holder. Stemware 22 is inserted into the holder at the fore end. The term "longitudinal" refers to the expanse of the stemware holder from fore to aft and the term "lateral" refers to the expanse of the stemware holder along a line normal to the longitudinal expanse of the holder.

Fingers 14 and 16 have fore end regions 32 and 34 respectively. These fore end regions are turned upward with respect to tray surface 30 and fingers 14 and 16 contact tray surface 30 along an underside fore end surface section slightly spaced from the periphery of the fore end regions. In other words, finger 14 contacts tray surface 30 along underside fore surface section 36.

Fore end regions 32 and 34 are upturned to enable easy insertion of stemware 22 into mouth 40 of the slot defined by inboard edges 42 and 44 respectively of fingers 14 and 16. Longitudinally extending aft from mouth or open fore region 40 is a converging throat region 46 that leads to circular, central region 48 of the slot. Central region 48 represents the truncated top of dome 12. In other words, dome 12 has truncated upper edges defined by inboard edge sections 50 and 52 respectively of fingers 14 and 16. Stem 24 is adapted to be disposed within central, circular region 48 of the slot. Extending aft from central region 48 is a stress relief section 54 of the slot. In this embodiment, the stress relief section is a key hole shape. A converging throat shape is defined by inboard edge sections 56 and 58 of fingers 14 and 16 that terminate in a generally circular cut-out 60 near aft region 18.

Fingers 14 and 16 are adapted to move laterally apart thereby expanding throat 46 to accommodate various stem sizes, one of which is stem 24 of stemware 20. Therefore, fingers 14 and 16 are integral and are made of a flexible and resilient material. Preferably, this material is plastic and in one embodiment, the plastic is manufactured by General Electric Company and sold under the tradename Lexan. Corporate headquarters of General Electric Company is in Fairfield, Conn.

As stated earlier, the fingers can move upward from tray surface 30 due to their flexibility in order to accommodate different size bases of the stemware. In general, the higher the base, the higher the arcuate contact band (compare arcs B to arcs A).

When stemware 20 is inserted into the slot (via mouth 40, throat section 46 and into central region 48), fingers 14 and 16 are generally displaced upward away from tray surface 30. Therefore, in order to provide a biasing downward force or a brace against further upward movement, stemware holder 10 includes ribs 60 and 62 that protrude upward from tray surface 30 generally normal to the surface plane. In this embodiment, the ribs are generally triangularly shaped (see FIG. 2) and are attached to the outside surface of each finger generally near aft region 18. Ribs 60 and 62 are also generally intermediate the stress relief slot section and outboard edges 26 and 28 respectively of fingers 14 and 16. The ribs extend longitudinally from aft region 18 and are generally in a plane parallel a plane through to the longitudinal center line of the stemware holder and normal to the tray surface. The intermediate placement of ribs 60 and 62 is principally based upon the contact force necessary to restrain stemware at the arcuate contacts, e.g., sections A and B. Dome 12 is symetrical about the longitudinal center line plane. The ribs have aft abutment surfaces 64 and 65. Surface 64 is shown clearly for rib 60 in FIG. 2. These abutment surfaces are described in detail with respect to FIGS. 4 and 5 later.

Stemware holder 10 can be attached to a tray below aft region 18. In this embodiment, the stemware holder has a tab 70 protruding away from tray surface 30. The lateral extent of tab 70 spans at least a distance equal to the lateral expanse between the outboard sides of ribs 60 and 62.

Figure 4:
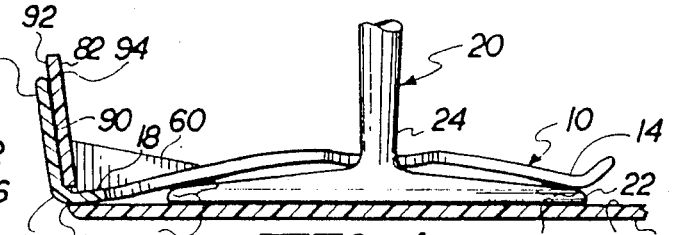
FIG. 4 illustrates the stemware holder mounted on a tray with a piece of stemware restrained by the holder, generally from the longitudinal, cross-sectional view similar to that of FIG. 2.

FIG. 4 shows stemware holder 10 restraining stemware 20. Base 22 contacts the underside of finger 14 along underside contact band section C. The center of band section C is arcuate contact Al in FIG. 1.

FIG. 4 also shows a tray 80 that has a side wall 82 extending above tray surface 84. Tray 82 has a through passage 86 through which extends a base portion 88 of tab 70. Inboard surface 90 of tab 70 is adjacent exterior surface 92 of side wall 82. In operation, the dome of stemware holder 10, in the absence of stemware 20, is forced against tray surface 84 due to the spring action between of tab 70 and the forward portions of holder 10. When stemware 20 is restrained by holder 10, rib 60 abuts inside surface 94 of side wall 82. Therefore, the ribs provide a downward biasing force on each of the fingers when a piece of stemware is restrained by the fingers. Also, the ribs provide a means for bracing the fingers to restrict the upward movement of the fingers with respect to tray surface 84.

FIG. 5 is a broken away, cross-sectional view of aft region 18 and shows an alternate configuration of side wall 82. In this embodiment, side wall 82 includes lip 96 that extends over the top of tab 70. Therefore, tab 70, lip 96 and side wall 82 form a composite wall for tray 80. FIG. 5 also shows rib 70 and abutment surface 64 that is spaced from inside surface 94 of side wall 82. In other words, when a piece of stemware is not restrained by the holder, as is the case in FIG. 5, abutment surfaces of the ribs are not adjacent the inside surfaces of the side wall of the trays.

Figure 6:
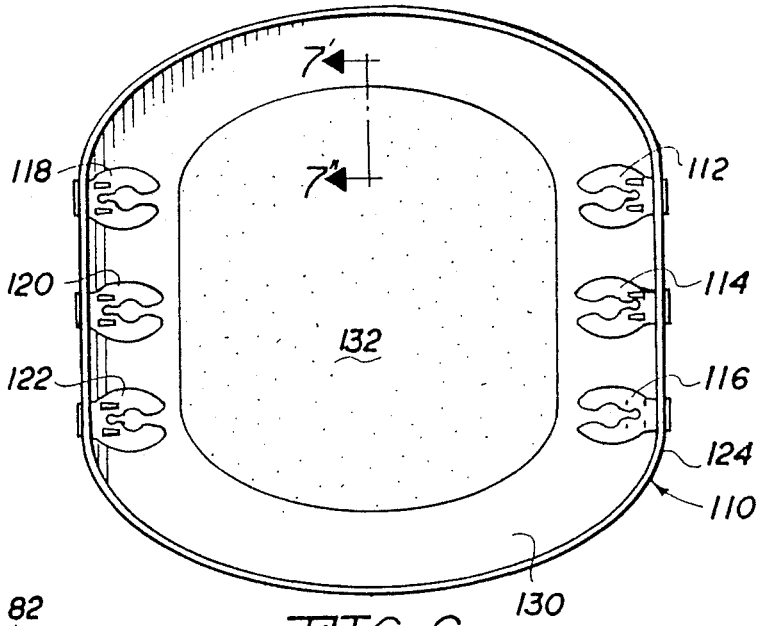
FIG. 6 illustrates a tray having several stemware holders and a central region; and, FIG. 7 illustrates a broken away, cross-sectional view of the tray and a portion of central region having a high coefficient of friction, from the perspective of section line 7'–7'' in FIG. 6.
Figure 6:
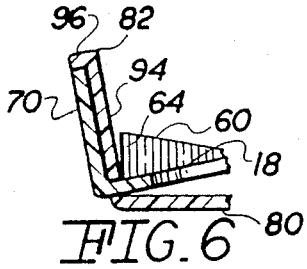

FIG. 6 illustrates tray 110 having a plurality of stemware holders 112, 114, 116, 118, 120, and 122 located at peripheral locations on side wall 124. Tray 110 includes a planar tray 130 and side wall 124 protrudes upwards from the top tray surface. Tray 110 has a central zone 132 that has a high coefficient of friction. The stemware holders are located outside of the central zone. With this configuration and due to the shallowness of each dome (i.e., holder), the tray can carry numerous plates since the plates can lay on top of the holders not being used to restrain stemware.

Figure 7:
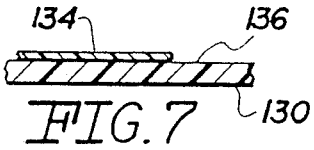

FIG. 7 shows a broken away, cross-sectional view of planar tray 160 with a surface layer 134 atop surface 136 of the tray. In one embodiment, layer 134 is a rubber-like material that has a high coefficient of friction which prohibits plates and other items, that are placed on the central region, to slide on the tray.

Figure 8:
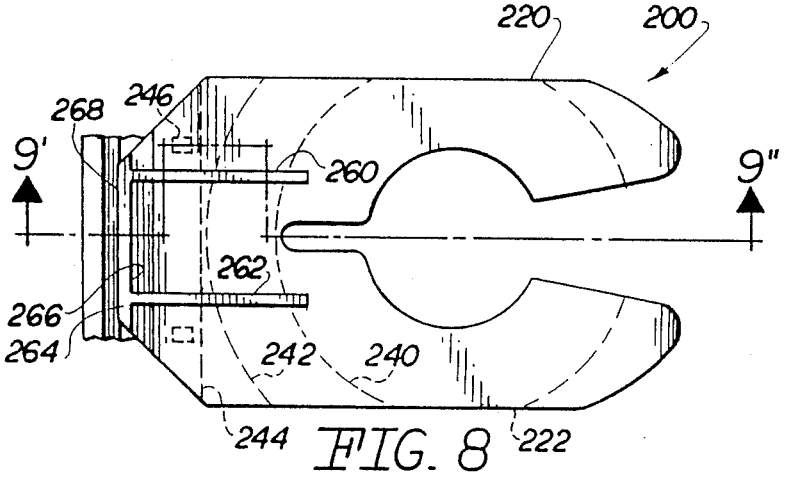
FIG. 8 illustrates the top view of a modified stemware holder.
Figure 9:
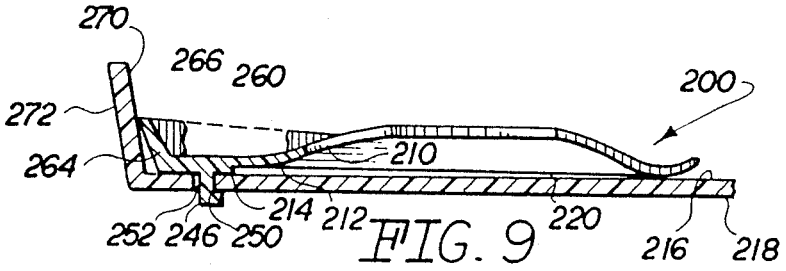
FIG. 9 illustrates the cross-sectional view of the holder from perspective of section line 9'–9'' in FIG. 8.

FIGS. 8 and 9 illustrate respectively a top view and a cross-sectional view of a modified stemware holder 200. The dome has three slopes or slopped steps 210, 212 and 214 along its underside. Slope steps 212 and 210 accommodate different sizes of stemware. Step 214 has O slope and sits adjacent tray surface 216 of tray 218. The outboard peripheral edges 220 and 222 of the fingers are in close proximity to tray surface 216. In a preferred embodiment, the distance between the outboard edges of holder 200 and tray surface 216 is 1/32 inches. FIG. 8 shows slope breaks 240, 242 and 244 as dashed lines.

Depending from slope step 214 is a clip-on mechanism 246. In this embodiment, the clip-on mechanism is hook 246 having a mouth 250 that spans a distance equal to the thickness of tray 218. Tray 218 has through passages, one of which is through passage 252 into which fits hook 246. Stemware holder 200 is adapted to securely snap onto 218 ny insertion of hook 246 into through passage 252 and then moving holder 200 laterally or to the right in FIG. 9 thereby inserting a portion of tray 218, proximate through passage 252, into 250 of hook 246. p As in the earlier embodiment, holder 20 includes ribs 260 and 262 that protrude above the top surfaces of the fingers normal to tray surface 216. However in this embodiment, aft tab 264 has an inboard surface 266 that is adjacent the aft portions of ribs 260 and 262. Preferably, the ribs are attached to inboard surface 266 of tab 264. Tab 264 also includes outboard surface 268 that is adapted to be placed adjacent interior surface 270 of side wall 272 of tray 218. As shown in FIG. 9, an interspace exists between tab 264 and side wall 272 near step 214 in order to snap-in or clip-on stemware holder 20 to tray 218.

The claims appended hereto are meant to cover modifications and changes within the scope and spirit of the present invention. For example, the attachment to the tray at aft region 18 can be other than that shown herein. A key feature is the spring type action of fingers 14 and 16 that are biased towards tray surface 30. Ribs 60 and 62 could be differently shaped as long as some type of bracing or biasing is present to limit the upward movement of the fingers with respect to the tray surface. Further, the stemware holders could be made integral with the tray rather than simply being "clipped" onto the side wall of the tray. These and other modifications and changes are meant to be encompassed by the accompanying claims.

What I claim is:

1. A stemware holder adapted to retain a stemware base against a tray surface comprising:

a dome defined by two fingers joined along an aft region, the outboard periphery of said fingers in close proximity to said tray surface and the inboard region of said fingers defining an open top of said dome, the inboard edges of said fingers defining a slot leading aft to said open top and having an open fore end, wherein the aft section is adapted to be attached to said tray surface.

2. A stemware holder as claimed in claim 1 wherein said open fore end is a mouth leading to a converging throat slot section, said open top forming a substantially circular section within which is adapted to be disposed said stem, and an aft slot section having a stress relief shape.

3. A stemware holder as claimed in claim 1 wherein said base is adapted to be contacted on the underside of said dome along arcuate contact regions thereby prohibiting movement of said stemware on said tray surface.

4. A stemware holder as claimed in claim 3 wherein each contact region is on the underside of said fingers.

5. A stemware holder as claimed in claim 3 wherein said open fore end is a mouth leading to a converging throat slot section, said open top forming a substantially circular section within which is adapted to be disposed said stem, and an aft slot section having a stress relief shape.

6. A stemware holder as claimed in claim 1 wherein said fingers are made of a resilient, flexible material such that said fingers are adapted to be forceably spread apart thereby temporarily increasing the lateral expanse of said slot and enabling insertion of said stem therein.

7. A stemware holder as claimed in claim 5 wherein said fingers are made of a resilient, flexible material such that said fingers are adapted to be forceably spread apart thereby temporarily increasing the lateral expanse of said slot and enabling insertion of said stem therein.

8. A stemware holder as claimed in claim 1 wherein a forward-most section of each said finger is upturned away from said tray surface.

9. A stemware holder as claimed in claim 1 including a tab extending upward relative to said tray surface from said aft region and adapted to have a tab inboard surface portion adjacent an external side wall surface of a tray, said side wall protruding upward from said tray surface, said tray having a through passage within which is disposed a section of said tab.

10. A stemware holder as claimed in claim 9 including means for bracing the upper aft sections of said fingers against an inboard side wall surface.

11. A stemware holder as claimed in claim 10 wherein said means for bracing is operative only when said stemware is restrained beneath said dome.

12. A stemware holder as claimed in claim 10 wherein said means for bracing is a pair of ribs, a respective rib corresponding to a respective finger, each rib affixed to said upper aft section of said corresponding finger.

13. A stemware holder as claimed in claim 12 wherein each rib is elongated, longitudinally extending at an intermediate location on said respective finger, rises normal to said tray surface above said respective upper aft surface, and includes side wall abutment edge at its aft surface.

14. A stemware holder as claimed in claim 13 wherein said abutment edge is adapted to be spaced from inboard side wall surface when no stemware is restrained by said holder and adapted to abut said inboard side wall surface when stemware is restrained by said holder.

15. A stemware holder as claimed in claim 12 wherein said open fore end is a mouth leading to a converging throat slot section, the open top forming a substantially circular section within which is adapted to be disposed said stem, and an aft slot section having a stress relief shape.

16. A stemware holder as claimed in claim 15 wherein said respective rib is disposed intermediate said stress relief shape and the outboard edge of said corresponding finger.

17. A stemware holder as claimed in claim 16 wherein each rib is elongated, longitudinally extending at an intermediate location on said respective finger, rises normal to said tray surface above said respective upper aft surface, and includes side wall abutment edge at its aft surface.

18. A stemware holder as claimed in claim 2 wherein said stress relief shape is a keyhole cut-out with a converging throat extending aft from said circular section.

19. A stemware holder as claimed in claim 18 wherein said respective rib is disposed intermediate said keyhole cut-out and the outboard edge of said corresponding finger.

20. A stemware holder for restraining a stemware base against a tray surface comprising:

two, thin, elongated and curved fingers, integral at their aft region, defining a dome rising from said tray surface with the top of said dome being open and the inboard edges of said fingers defining a fore entry slot through which the stem of said stemware passes leading to said open top, and means for attaching said aft region onto said tray surface.

21. A tray comprising:

a planar tray having a side wall protruding upward from a top tray surface;

a central zone of said tray surface having a high coefficient of friction;

a plurality of stemware holders for restraining the stemware base against said tray surface, each holder including:

two, thin, elongated and curved fingers, integral at their aft region, defining a dome rising from said tray surface with the top of said dome being open and the inboard edges of said fingers defining a fore entry slot through which the stem of said stemware passes leading to said open top, and means for attaching said aft region onto said tray surface at the side wall.

22. A tray as claimed in claim 21 wherein said fingers are made of a resilient, flexible material such that said fingers are adapted to be forceably spread apart thereby temporarily increasing the lateral expanse of said slot and enabling insertion of said stem therein.

23. A tray as claimed in claim 22 wherein said side wall includes a plurality of through passages, said means for attaching includes a tab extending upward relative to said tray surface from the aft edge of said fingers and adapted to have a tab inboard surface portion adjacent an external side wall surface and a section of said tab extending through said passage.

24. A tray as claimed in claim 21 wherein said tray includes a plurality of through passages near said side wall, said means for attaching includes means for clipping onto said tray extending through a respective through passage and cooperating with the underside of said tray, said holder including a tab extending upward relative to said tray surface and having an outboard surface portion adapted to be positioned adjacent an interior side wall surface.

25. A stemware holder as claimed in claim 1 including a tab extending upward relative to said tray surface from said aft region and adapted to have a tab outboard surface portion adapted to be positioned adjacent an interior side wall surface of a tray, said side wall protruding upward from said tray surface.

26. A stemware holder as claimed in claim 25 wherein said tray has a through passage vertically aligned with an underside section of said aft region, and the stemware holder includes a depending means for clipping said aft region onto said tray which extends through said through passage and clips onto said tray.

27. A stemware holder as claimed in claim 26 wherein said tray has a pair of through passages and the stemware holder includes a pair of depending means for clipping.

28. A stemware holder as claimed in claim 27 wherein said depending means for clipping includes a hook having a mouth spanning a distance equal to the thickness of said tray proximate said through passages.

29. A stemware holder as claimed in claim 25 including reinforcing wall means for bracing the upper aft sections of said fingers against said tab.

30. A stemware holder as claimed in claim 29 wherein said wall means for bracing is a pair of ribs, a respective rib corresponding to a respective finger, each rib affixed to said upper aft section of said corresponding finger and extending aft to said tab.

31. A stemware holder as claimed in claim 30 wherein each rib is elongated, longitudinally extending at an intermediate location on said respective finger, rises normal to said tray surface above said respective upper aft surface, and includes an aft edge section affixed to said tab.

32. A stemware holder as claimed in claim 30 wherein said open fore end is a mouth leading to a converging throat slot section, the open top forming a substantially circular section within which is adapted to be disposed said stem, and an aft slot section having a stress relief shape.

33. A stemware holder as claimed in claim 32 wherein said respective rib is disposed intermediate said stress relief shape and the outboard edge of said corresponding finger.

34. A stemware holder as claimed in claim 1 wherein said dome has three, stepped slope sections along an underside region such that the radially outermost and aftmost stepped slope is substantially in contact with said tray surface when said holder is attached to said tray surface.

35. A stemware holder as claimed in claim 34 wherein said tray has a through passage vertically aligned with an underside section of said aft region, and the stemware holder includes a depending means for clipping said aft region onto said tray which extends through said through passage and clips onto said tray.

36. A stemware holder as claimed in claim 35 wherein said underside section of said aft region is said radially outermost stepped slope.

37. A stemware holder adapted to retain a stemware base against a tray surface comprising:

a dome defined by two fingers joined along an aft region, the outboard periphery of said fingers in close proximity to said tray surface and the inboard region of said fingers defining an open top of said dome, the inboard edges of said fingers defining a slot leading aft to said open top and having an open fore end, wherein the aft section is adapted to be attached to said tray surface; and a tab extending upward from said aft section and adapted to be positioned adjacent an interior side wall surface of a tray.

38. A tray comprising:

a planar tray having a side wall protruding upward from a tray surface;

a central zone of said tray surface having a high coefficient of friction;

a plurality of stemware holders for restraining the stemware base against surface, each holder including:

two, thin, elongated and curved fingers, integral at their aft region, defining a dome rising from said tray surface with the top of said dome being open and the inboard edges of said fingers defining a fore entry slot through which the stem of said stemware passes leading to said open top, and means for attaching said aft region onto said tray surface at the side wall; and wherein said tray includes a plurality of through passages near said side wall, and said means for attaching includes means for clipping onto said tray, said means for clipping extending through a respective through passage and cooperating with the underside of said tray, each said holder including a tab extending upward and adapted to be positioned adjacent an interior side wall surface.

* * * * *